US005461855A

United States Patent [19]

Inoue et al.

[11] Patent Number: 5,461,855

[45] Date of Patent: Oct. 31, 1995

[54] METHOD AND DEVICE FOR CONTROLLING COMBUSTORS FOR GASTURBINE

[75] Inventors: Hiroshi Inoue; Satoshi Tsukahara, both of Hitachi; Kazumi Iwai, Mito, all of Japan

[73] Assignee: Hitachi, Ltd., Tokyo, Japan

[21] Appl. No.: 193,354

[22] Filed: Feb. 3, 1994

Related U.S. Application Data

[63] Continuation of Ser. No. 800,261, Nov. 29, 1991, abandoned.

[30] Foreign Application Priority Data

Nov. 30, 1990 [JP] Japan ..... 2-329445

[51] Int. Cl.[6] ..... F23C 1/00

[52] U.S. Cl. ..... 60/39.06

[58] Field of Search ..... 60/39.06, 39.23, 60/39.29, 737, 39.02

[56] References Cited

U.S. PATENT DOCUMENTS

| | | | |
|---|---|---|---|
| 2,655,787 | 10/1953 | Brown | 60/39.23 |
| 4,054,028 | 10/1977 | Kawaguchi | 60/39.23 |
| 4,138,842 | 2/1979 | Zwick | 60/39.23 |
| 4,151,711 | 5/1979 | From et al. | 60/39.29 |
| 4,179,880 | 12/1979 | Schirmer | 60/39.23 |
| 4,606,190 | 8/1986 | Greene | 60/39.29 |

FOREIGN PATENT DOCUMENTS

| | | |
|---|---|---|
| 1150715 | 6/1989 | Japan . |
| 61210233 | 9/1989 | Japan . |
| 2226366 | 6/1990 | United Kingdom . |

OTHER PUBLICATIONS

57–179519 Japan—Abstract (Nov. 1982).

European Search Report EP 91 31 1080 (Mar. 1992).

*Primary Examiner*—Timothy S. Thorpe

*Attorney, Agent, or Firm*—Antonelli, Terry, Stout & Kraus

[57] ABSTRACT

A method for controlling a plurality of combustors supplying a pressurized gas to a gas turbine, with each of the combustors including a first air supply for supplying a combustion air into the combustor and a second air supply for adjusting an amount of air supplied into the combustor to change a combustion condition in the combustor. The method comprises the steps of measuring the combustion condition of each of the combustors, measuring a difference between the measured combustion condition of each of the combustors and a desired combustion condition, and changing a rate of the amount of air supplied into the combustor by the second air supply means in relation to an amount of combustion air supplied into the combustor by the first air supply in each of the combustors according to the measured difference of each of the combustors to change the combustion condition of each of the combustors so that the combustion conditions of the combustors are changed to the desired combustion condition.

15 Claims, 7 Drawing Sheets

METHOD AND DEVICE FOR CONTROLLING COMBUSTORS FOR GASTURBINE

This application is a Continuation of application Ser. No. 07/800,261, filed Nov. 29, 1991, now abandoned.

BACKGROUND OF THE INVENTION AND RELATED ART STATEMENT

The present invention relates to a method and device for controlling a plurality of combustors supplying a pressurized gas to a gas turbine.

In a conventional device for controlling a plurality of combustors supplying a pressurized gas to a gas turbine as shown in FIGS. 3, 4A and 4B, air A from a compressor (not shown) is supplied into a combustor 115 through a casing 110, diffusion combustion air supply orifices 113 of a diffusion combustion chamber 130, air supply orifices 114 of a pre-mix combustion chamber 131 and pre-mix combustion air supply orifices 133 of a pre-mixing swirler 132. A diffusion combustion fuel F1 is injected from diffusion combustion nozzles 134 into the diffusion combustion chamber 130, a pre-mix combustion fuel F2 is injected from pre-mix combustion nozzles 135 into the pre-mixing swirler 132. Air heated by a fuel combustion, to be pressurized is supplied from the combustor 115 to a gas turbine 138 to rotate the gas turbine 138. An open area of the pre-mix combustion air supply orifices 133 is changed by a valve 118 driven by a driver 121. A controller 119 controls a supply rate of the diffusion combustion fuel F1 according to a load of the gas turbine 138 in dependance upon a predetermined relationship between the supply rate of the diffusion combustion fuel F1 and the load of the gas turbine 138 as shown by a solid line in FIG. 4A, and controls a supply rate of the pre-mix combustion fuel F2 in dependance upon the load of the gas turbine 138 on the basis of a predetermined relationship between the supply rate of the pre-mix combustion fuel F2 and the load of the gas turbine 138 as shown by a broken line in FIG. 4A. Further, the controller 119 controls the open area of the pre-mix combustion air supply orifices 133 with the valve 118 being driven by the driver 121 in dependance upon the load of the gas turbine 138 on the basis of a predetermined common relationship between the open area of the pre-mix combustion air supply orifices 133 and the load of the gas turbine 138 as shown in FIG. 4B.

Japanese Patent Unexamined Publication No. 61-210233 proposes a construction in which a fuel supply rate for each of the combustion chambers is controlled in accordance with a difference between a temperature of a turbine exhaust gas from each of the combustion chambers and an average value of the turbine exhaust gas temperatures from all of the combustion chambers so that the turbine exhaust gas temperatures from all of the combustion chambers are substantially equal to each other.

Japanese Patent Unexamined Publication No. 1-150715 proposes a construction in which both of a flow rate of a main combustion air for burning a solid fuel and a flow rate of a supplemental combustion air for burning a supplemental fuel are simultaneously increased or decreased in accordance with a density e.g. concentration of a component of the turbine exhaust gas.

OBJECT AND SUMMARY OF THE INVENTION

An object of the present invention is to provide a method and device for controlling a plurality of combustors supplying a pressurized gas to a gas turbine, wherein combustion conditions of the combustors can be changed to a desired conbustion condition without a variation of output of the gas turbine.

According to the present invention, a method for controlling a plurality of combustors supplying a pressurized gas to a gas turbine, each of which combustors includes a first air supply means for supplying a combustion air into the combustor and a second air supply means for adjusting an amount of air supplied into the combustor to change a combustion condition in the combustor, comprises the steps of measuring the combustion condition of each of the combustors, measuring a difference between the measured combustion condition of each of the combustors and a desired combustion condition, and changing a rate of the amount of air supplied into the combustor by the second air supply means in relation to an amount of combustion air supplied into the combustor by the first air supply means in each of the combustors according to the measured difference of each of the combustors to change the combustion condition of each of the combustors so that the combustion condition of each of the combustors so that the combustion conditions of the combustors are made substantially equal to each other.

According to the present invention, a device for controlling a plurality of combustors supplying a pressurized gas to a gas turbine, each of which combustors includes a first air supply means for supplying a combustion air into the combustor and a second air supply means for adjusting an amount of air supplied into the combustor to change a combustion condition in the combustor, comprises means for measuring the combustion condition of each of the combustors, means for measuring a difference between the measured combustion condition of each of the combustors and a desired combustor condition, and means for changing a rate of the amount of air supplied into the combustor by the second air supply means in relation to an amount of combustion air supplied into the combustor by the first air supply means in each of the combustors according to the measured difference of each of the combustors to change the combustion condition of each of the combustors so that the combustion conditions of the combustors are made substantially equal to each other.

Since the rate of the amount of air supplied into the combustor by the second air supply means in relation to the amount of combustion air supplied into the combustor by the first air supply means in each of the combustors is changed according to a difference between the combustion condition of each of the combustors and the desired combustion condition to change the combustion condition of each of the combustors so that the combustion conditions of the combustors are made substantially equal to each other without substantially changing an amount of fuel supplied to each of the combustors to change the combustion condition of each of the combustors, the combustion condition of each of the combustors can be changed to the desired combustion condition without a variation of output of the gas turbine or with keeping the output of the gas turbine constant.

The combustion condition of each of the combustors can be measured from, for example, a condition of the pressurized gas generated in each of the combustors. That is, the combustion condition may be the condition of the pressurized gas.

DETAILED DESCRIPTION OF PREFERRED EMBODIMENTS

Figure 1:
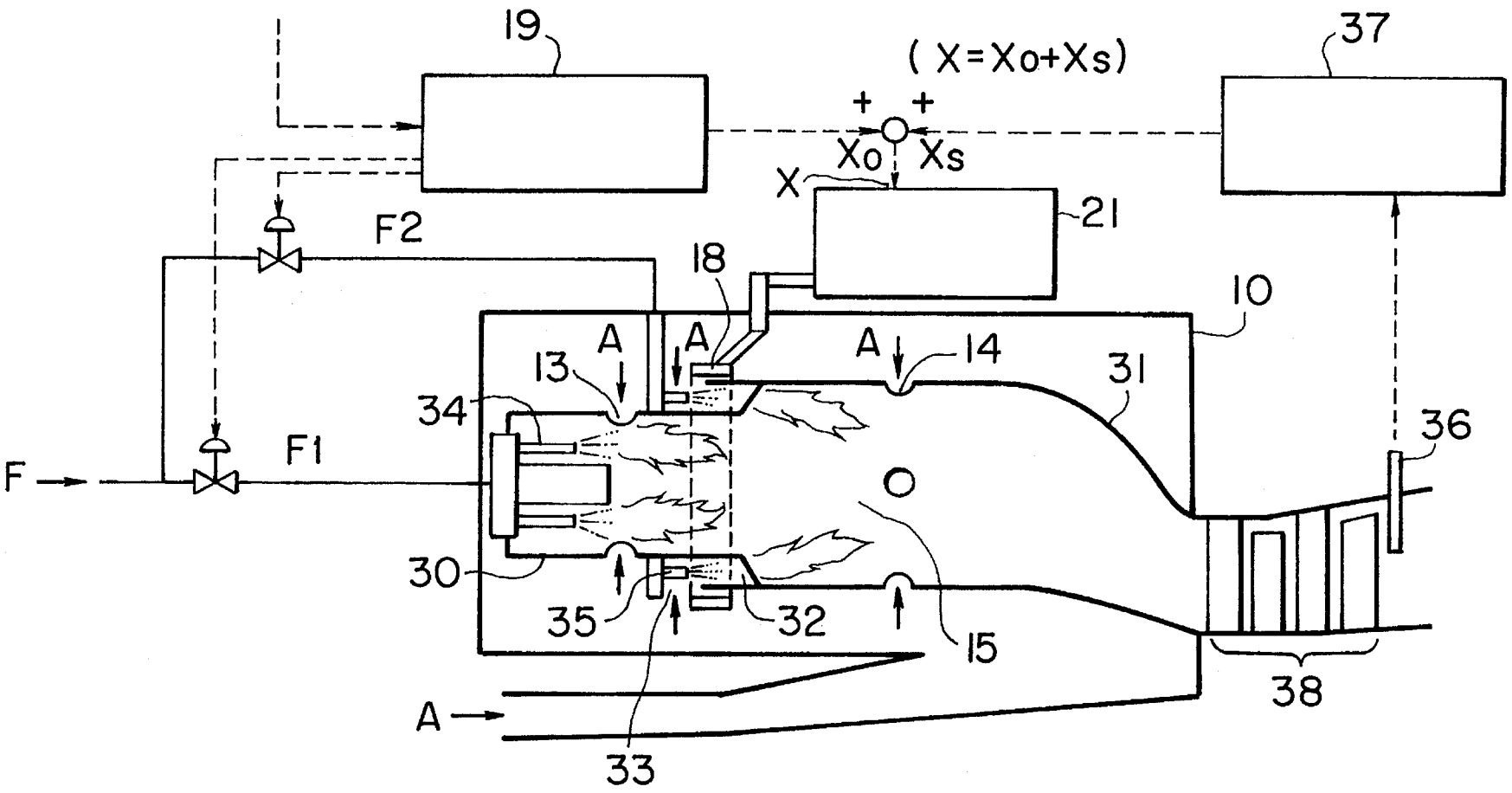
FIG. 1 is a schematic view of a combustor according to the present invention.

As shown in FIG. 1, one of combustors for supplying a pressurized gas to a gas turbine includes a first combustion part into which an air and a fuel are supplied directly and separately to form a diffusion combustion and a second combustion part into which a mixture of the air and fuel mixed previously with each other is supplied to form a premixed combustion. The premixed combustion is effective for decreasing a density of NOx component of a gas discharged from the combustor. Air A is supplied to a combustor casing 10 by a compressor (not shown) and is fed into a combustion chamber 15 through orifices 13 on a diffusion combustion liner 30, an orifices 14 on a premixed combustion liner 31 and orifice 33 on a premixed combustion swirler 32. A diffusion combustion fuel F1 is injected into the combustion chamber 15 by fuel nozzles 34 to form the diffusion combustion. A premixed combustion fuel F2 is injected into the premixed combustion swirler 32 by fuel nozzles 35 to be mixed with the air therein to form the mixture of the air and fuel with an appropriate mixing rate therebetween before the mixture flows into the combustion chamber 15 to be burned therein. A pressurized gas generated from the diffusion combustion and the premixed combustion is mixed with the air supplied from the orifices 14 and the mixed pressurized gas flows to a gas turbine 38.

Figure 2A:
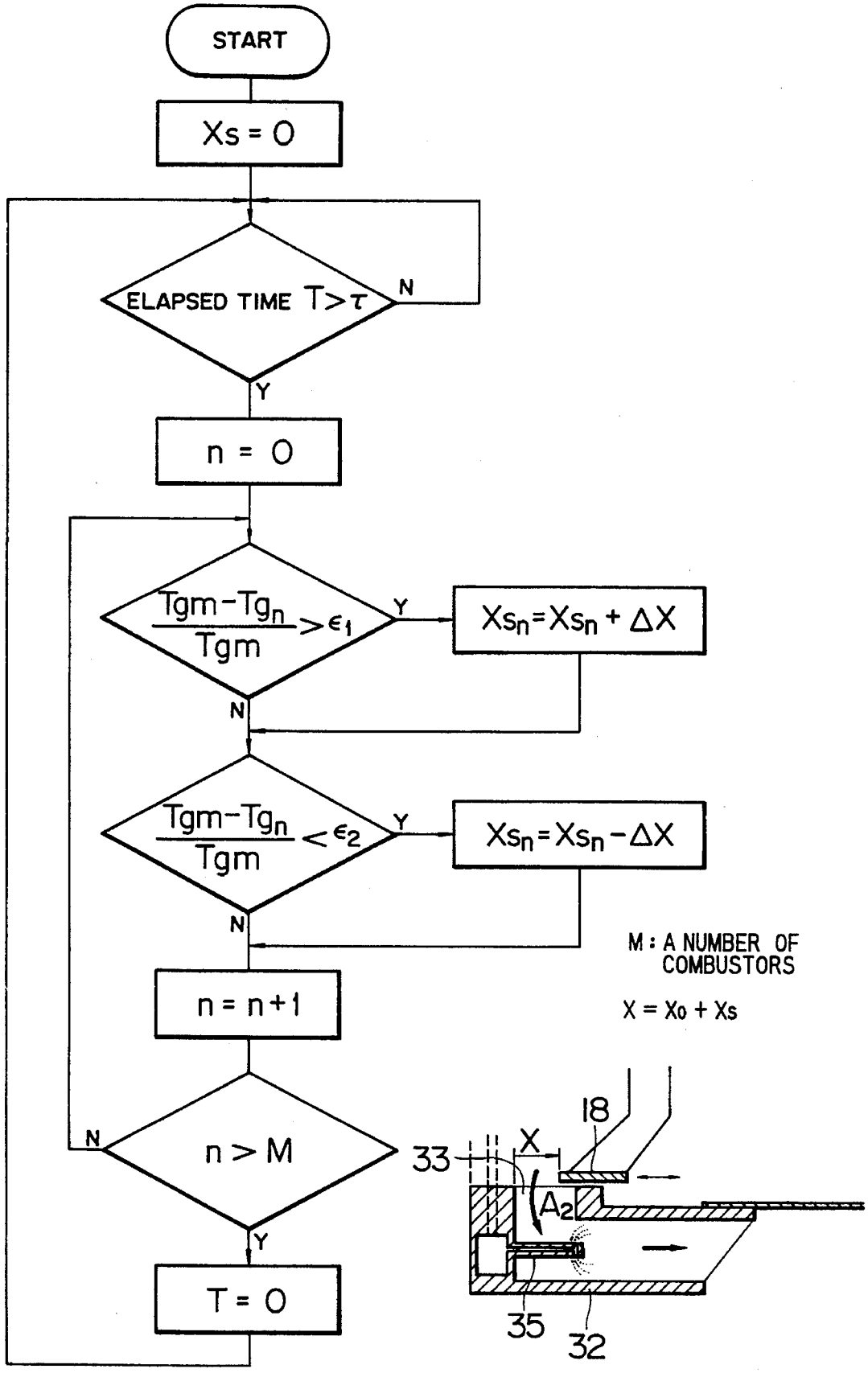
FIG. 2A is a flow chart showing an embodiment for changing the amount of air supplied into the combustor according to the present invention.
Figure 2B:
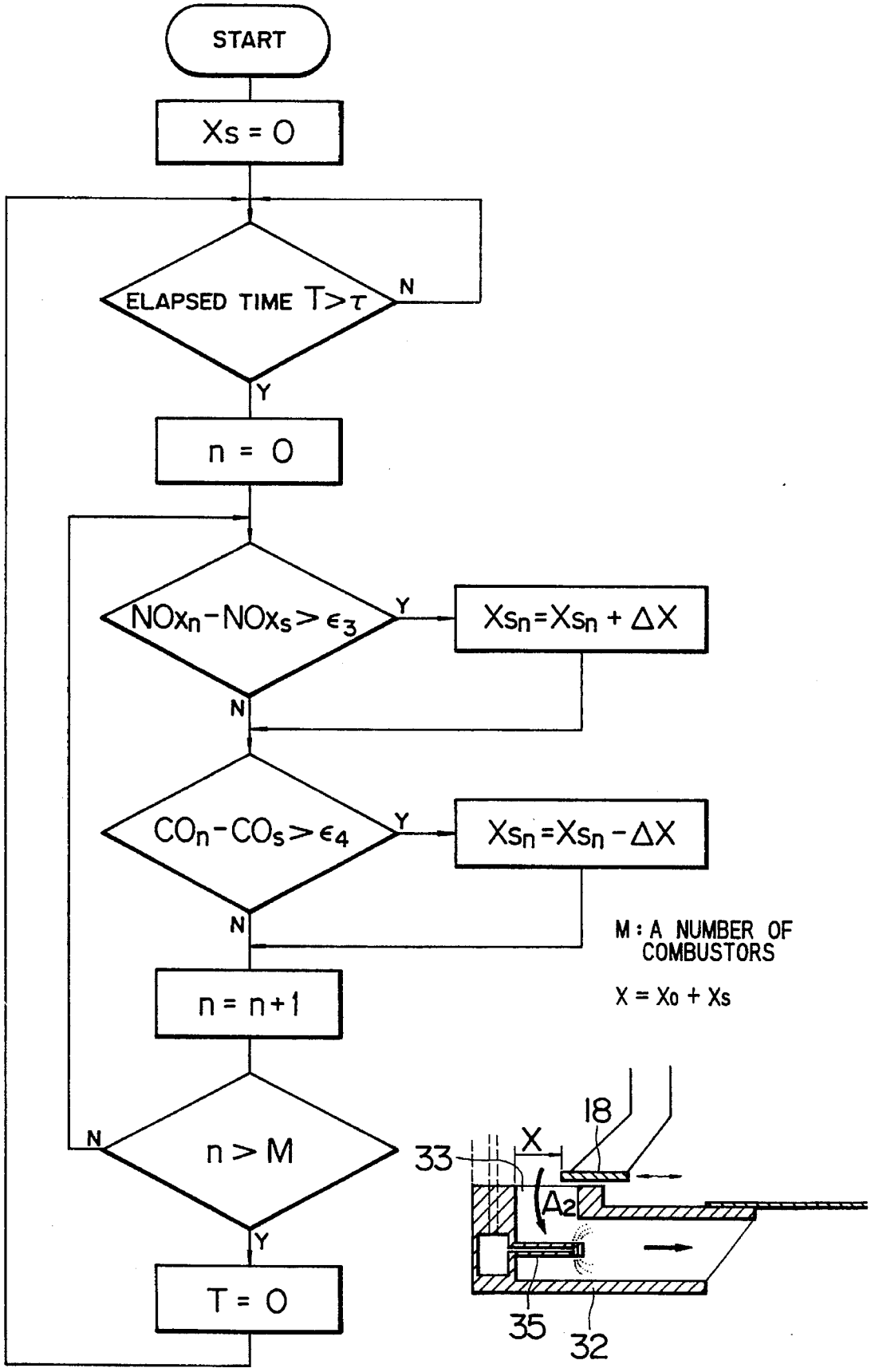
FIG. 2B is a flow chart of another embodiment for changing the amount of air supplied into the combustor according to the present invention.
Figure 3:
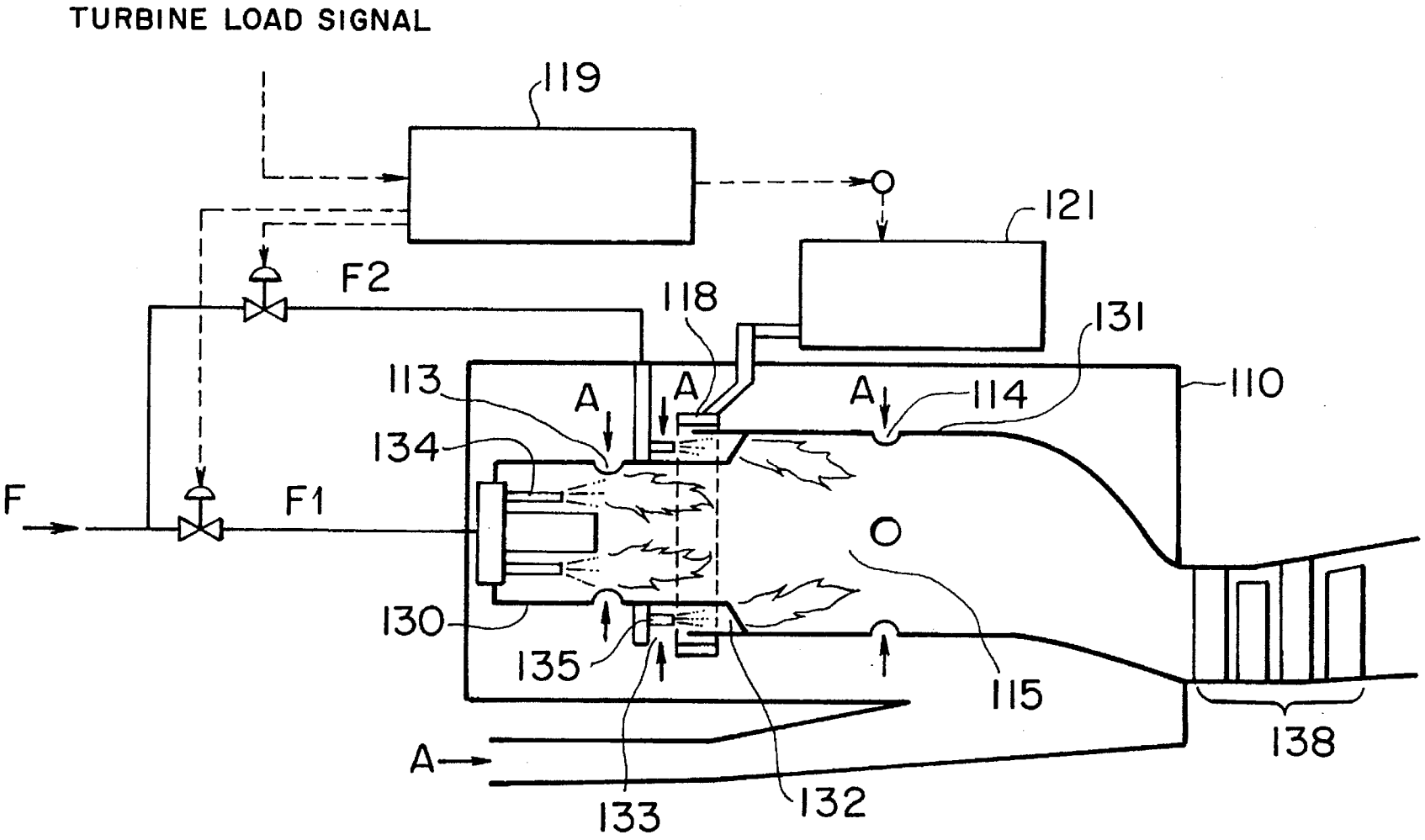
FIG. 3 PRIOR ART
FIG. 3 is a schematic view of a conventional combustor for supplying a pressurized gas to a gas turbine.
Figure 4A:
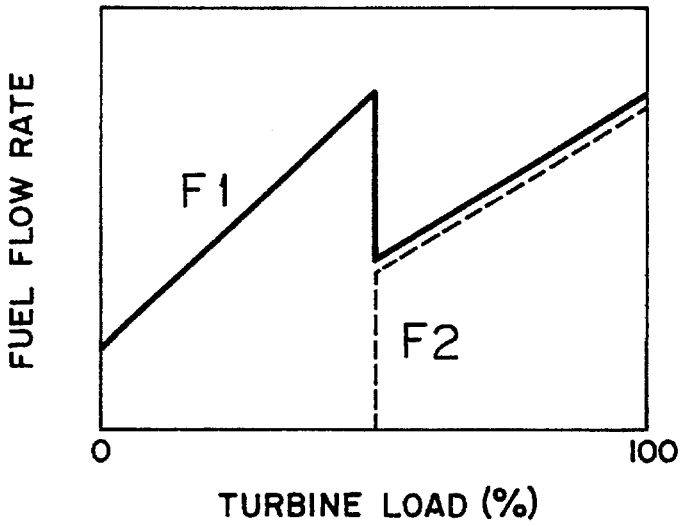
FIG. 4A PRIOR ART
FIG. 4A is a diagram of a predetermined relationship between a turbine load and a fuel supply rate in the conventional combustor.
Figure 4B:
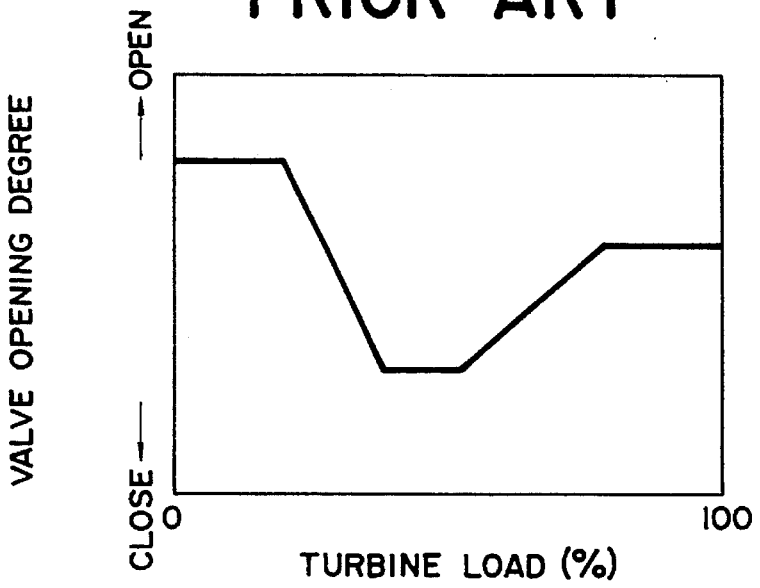
FIG. 4B PRIOR ART
FIG. 4B is a diagram of a predetermined relationship between a turbine load and a valve opening degree for supplying air into the conventional combustor.
Figure 6A:
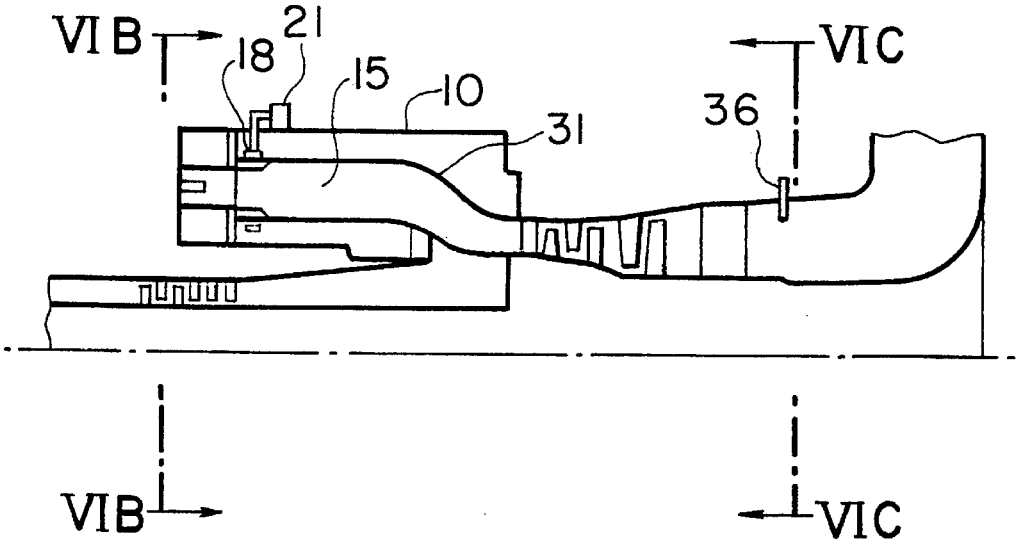
FIGS. 6A, 6B and 6C are schematic views of an arrangement of the combustors and sensors for measuring the combustion condition of each of the combustors or the condition of the pressurized gas generated by each of the combustors.
Figure 6B:
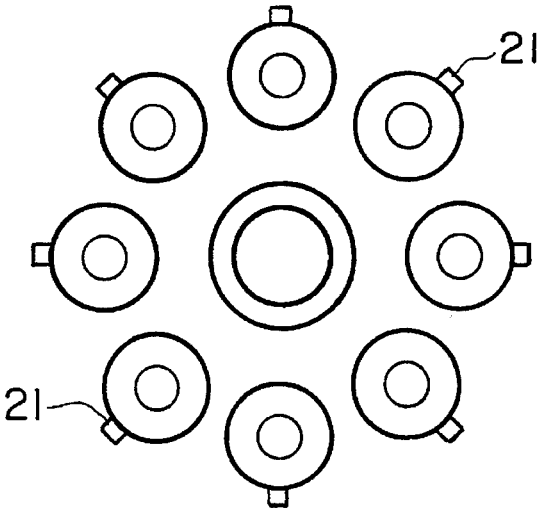
Figure 6C:
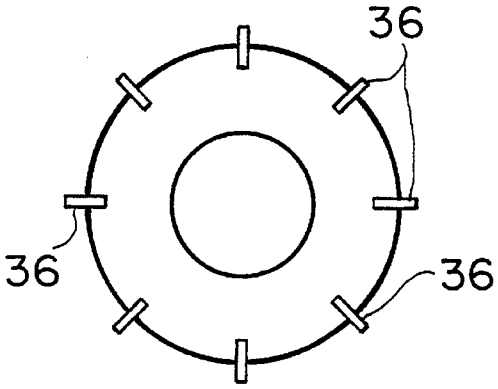

A valve 18 adjusts or changes a rate of an amount or flow rate of air supplied into the second combustion part of the premixed combustion in relation to an amount or flow rate of air supplied into the first combustion part of the diffusion combustion in each of the combustion chambers 15. In a controller 19, a basic opening degree Xo of the valve 18 as shown in FIGS. 2A and 2B is determined according to a desired output of the gas turbine 38 or a required operation thereof on the basis of a predetermined relationship between the basic opening degree Xo and the desired output or required operation of the gas turbine 38 so that the basic opening degree Xo is output to a driver 21. An output of each of sensors 36 for measuring a combustion condition of each of the combustion chambers 15 or a condition of the pressurized or exhaust gas generated by each of the combustion chambers 15 is transmitted to a valve opening degree determining device 37. Each of the sensors 36 measures, for example, a temperature of the exhaust gas or a density of a component of the exhaust gas. As shown in FIG. 6A, 6B and 6C, the number of the sensors 36 is equal to the number of the combustion chambers 15 and the sensors 36 are arranged around the gas turbine 38 at the outside thereof with a constant circumferential distance between the sensors 36 adjacent to each other. Since a flow of the pressurized gas from each of the combustion chambers 15 is twisted around the gas turbine 38 by a rotation thereof, the condition of the pressurized gas from each one of the combustion chambers 15 is measured by the respective sensors at a circumferentially separate position from the each of the combustion chambers 15.

As shown in FIG. 2A, in the valve opening degree determining device 37, a difference between a temperature Tg measured by each of the sensors 36 and a desired temperature Tgm is calculated. The desired temperature may be the most appropriate temperature which is previously determined or is calculated from the other operational conditions, an average temperature of all of the measured temperatures Tg, an average temperature of the measured temperatures Tg other than the measured temperature Tg on which the difference is being calculated or an average temperature of the measured temperatures Tg of at least two of the combustors. When the measured temperature Tg minus the desired temperature/the desired temperature Tgm is greater than a predetermined degree $\epsilon 1$, a compensation degree Xs is increased from the previously determined compensation degree Xs by a predetermined degree $\Delta x$ so that an opening degree X of the valve 18 is adjusted or increased to the basic opening degree Xo plus (the previous compensation degree (Xs $+\Delta x$ to increase an air flow A2 to the premixed combustion part. When the desired temperature minus the measured temperature Tg/the desired temperature Tgm is larger than a predetermined degree $\epsilon 2$, the compensation degree Xs is decreased from the previously determined compensation degree Xs by the predetermined degree $\Delta x$ so that the opening degree X of the valve 18 is adjusted or decreased to the basic opening degree Xo plus (the previous compensation degree (Xs $-\Delta x$) to decrease the air flow A2 to the premixed combustion part. Alternatively, when the measured temperature Tg minus the desired temperature is larger than the predetermined degree $\epsilon 1$, the compensation degree Xs is increased from the previously determined compensation degree Xs by the predetermined degree $\Delta x$ so that the opening degree X of the valve 18 is adjusted or increased to the basic opening degree Xo plus the previous compensation degree (Xs $+\Delta x$) to increase the air flow A2 to the premixed combustion part. When the desired temperature minus the measured temperature Tg is larger than the predetermined degree $\epsilon 2$, the compensation degree Xs is decreased from the previously determined compensation degree Xs by the predetermined degree $\Delta x$ so that the opening degree X of the valve 18 is adjusted or decreased to the basic opening degree Xo plus the previous conpensation degree (Xs $-\Delta x$) to decrease the air flow A2 to the premixed combustion part. The degree $\Delta x$ may be in proportion to the difference between the temperature Tg measured by each of the sensors 36 and the desired temperature Tgm. This operation is carried out for each of the combustors or combustion chambers 15 in order. A set of these ordered operations for the combustors or combustion chambers 15 is carried out with a constant interval $\tau$ from the previous set, for example, with the interval of ten seconds. As a result of the above operations, the temperatures of the pressurized gas from the combustors or combustion chambers 15 are made substantially equal to each other or changed to the desired temperature.

The sensors 36 may measure a density of NOx and/or CO and/or hydro-carbon of the pressurized gas. As shown in FIG. 2B, a difference between a NOx density measured by each of the sensors 36 and a desired NOx density is calculated, and a difference between a CO density measured by each of the sensors 36 and a desired CO density is calculated. The desired densities of NOx and CO are predetermined. When the measured NOx density minus the desired NOx density is larger than a predetermined degree $\epsilon 3$, the compensation degree Xs is increased from the previously determined compensation degree Xs by the predetermined degree $\Delta x$ so that the opening degree X of the valve 18 is adjusted or increased to the basic opening degree Xo plus the previous compensation degree ($Xs + \Delta x$) to increase the air flow A2 to the premixed combustion part. When the measured CO density minus the desired CO density is larger than a predetermined degree $\epsilon 4$, the compensation degree Xs is decreased from the previously determined compensation degree Xs by the predetermined degree $\Delta x$ so that the opening degree X of the valve 18 is adjusted or decreased to the basic opening degree Xo plus the previous compensation degree ($Xs - \Delta x$) to decrease the air flow A2 to the premixed combustion part. The degree $\Delta x$ may be in proportion to the difference between the density measured by each of the sensors 36 and the desired density.

Figure 5:
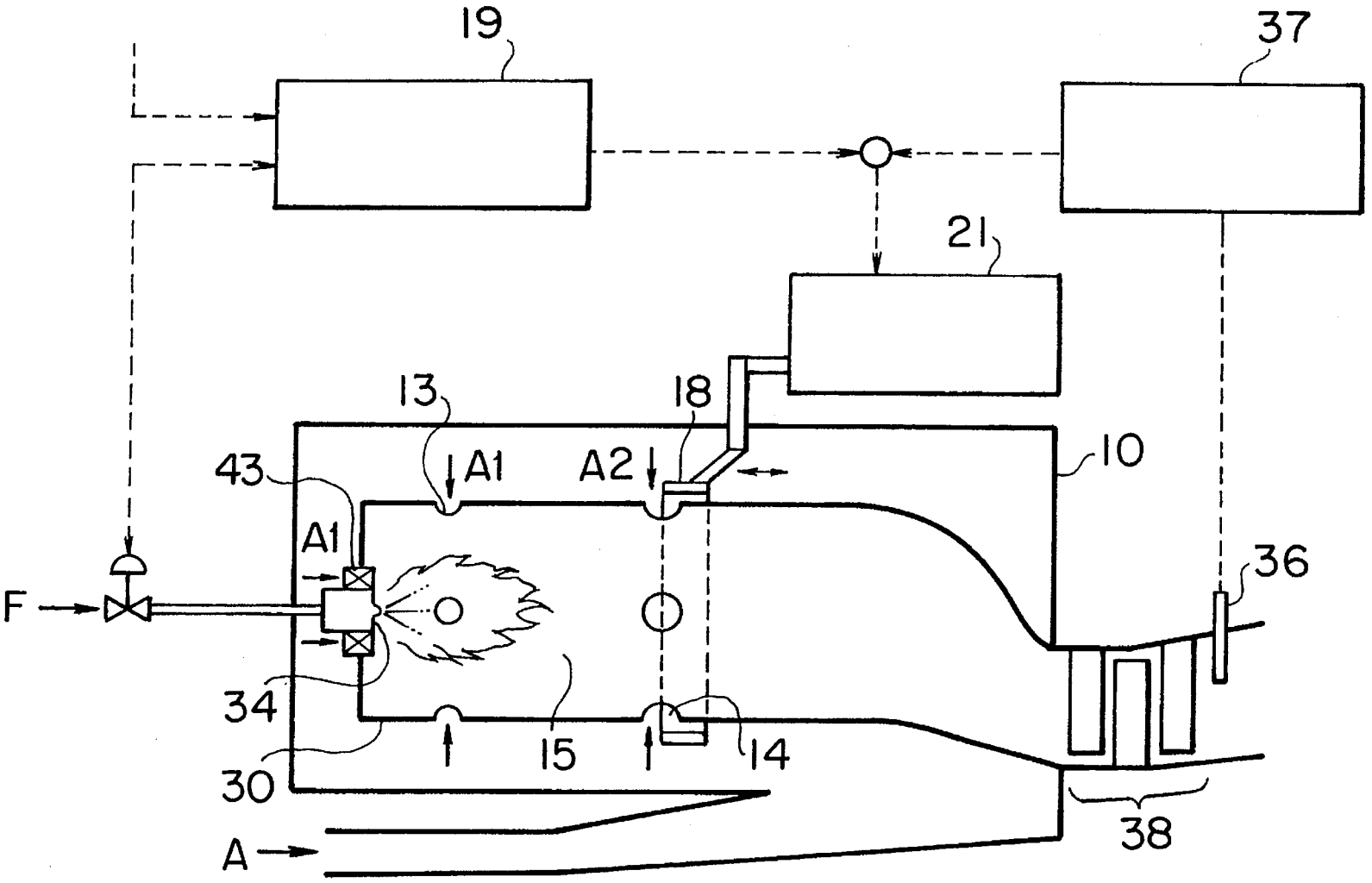
FIG. 5 is a schematic view of another combustor according to the present invention.

In an embodiment as shown in FIG. 5, each of the combustors or combustion chambers 15 includes a diffusion combusion part and does not include a premixed combustion part. The valve 18 is arranged at a downstream side of the diffusion combusion part to change a flow rate of air supplied into the combustion chamber 15 or added to the pressurized gas generated by the diffusion combusion part, through the orifices 14. The air A from the compressor (not shown) is supplied into the casing 10. Subsequently, air A1 flows into the combustion chamber 15 through orifices 43 and the orifices 13 on the combustion liner 30 and air A2 flows into the combustion chamber 15 through the orifices 14 on the combustion liner 30. The fuel F is injected from the nozzle 34 into the combustion chamber 15 to form the diffusion combustion with the air. When the fuel is a combustible gas made from coal and includes large percents of nitrogen atoms, it is effective for decreasing a density of NOx in the pressurized gas from the combustion chamber 15 that the diffusion combustion is carried out with an insufficient flow rate of the air Al supplied into the combustion chamber 15 through the orifices 43 and 13 in relation to a flow rate of the fuel F supplied into the combustion chamber 15 through the nozzle 34 so that the fuel F is not completely burned up by the air A1 to change the nitrogen atoms to nitrogen molecules ($N_2$) and subsequently a part of the fuel F which was not burned up by the diffusion combustion is burned up by the air A2.

In order to obtain the above operation for decreasing the density of NOx in the pressurized gas, that is, to obtain so called a rich-lean combustion, the opening degree X of the valve 18 is increased to increase the air flow A2 when a NOx density measured by each of the sensors 36 is larger than a predetermined desired NOx density, and the opening degree X of the valve 18 is decreased to decrease the air flow A2 when a density of the part of the fuel F which was not burned up by the diffusion combustion is greater than a predetermined desired density thereof.

What is claimed is:

1. A method for controlling a plurality of combustors supplying a pressurized gas to a gas turbine, each of said combustors includes a combustion chamber having a first diffusion combustion part and a second premixed combustion part, a first air supply means for supplying a combustion air into the first, diffusion combustion part of said combustion chamber, and a second air supply means for adjusting an amount of air supplied into the second, premixed combustion part of said combustion chamber of the combustor to change a combustion condition of the combustor, the method comprising the steps of:

measuring at least one of a temperature and a concentration of a component of the pressurized gas from a respective combustor of said plurality of combustors which corresponds to a combustion condition of the combustor, measuring a difference between the measured value of the pressurized gas and a desired value thereof which corresponds to a desired combustion condition of the combustor, and changing a rate of the amount of air supplied by the second air supply means of said respective combustor with respect to an amount of combustion air supplied by the first air supply means thereof in accordance with the measured difference to change a combustion condition of said respective combustor, and wherein said steps are performed for each of said plurality of combustors so that the combustion conditions of the combustors are changed to the desired combustion condition.

2. A method according to claim 1, wherein the desired combustion condition is an average combustion condition of the measured combustion conditions of at least two of the combustors.

3. A method according to claim 1, wherein the desired combustion condition is an appropriate combustion condition of the combustor based upon a load condition of the combustor.

4. A method according to claim 1, wherein the first air supply means supplies the combustion air for a diffusion combustion, and the second air supply means supplies an additional air to be added into the pressurized gas generated by the diffusion combustion.

5. A method according to claim 1, wherein, in each of the combustors, the rate of the amount of air supplied into the combustor by the second air supply means in relation to the amount of combustion air supplied into the combustor by the first air supply means is changed by a degree which is in proportion to the measured difference of each of the combustors.

6. A method according to claim 1, wherein, in each of the combustors, the change in the rate of the amount of air supplied into the combustor by the second air supply means in relation to the amount of combustion air supplied into the combustor by the first air supply means is a predetermined amount.

7. A method according to claim 1, wherein the temperature of the pressurized gas is measured and wherein, in each of the combustors, the rate of the amount of air supplied into the combustor by the second air supply means in relation to the amount of combustion air supplied into the combustor by the first air supply means is increased when the measured temperature of the pressurized gas is higher than the desired temperature of the pressurized gas, and the rate of the amount of air supplied into the combustor by the second air supply means in relation to the amount of combustion air supplied into the combustor by the first air supply means is decreased when the measured temperature of the pressurized gas is lower than the desired temperature of the pressurized gas.

8. A method according to claim 1, wherein a concentration density of a NOx (nitrogen oxide) component of the pressurized gas is measured as the measured combustion condition, the desired combustion condition is a desired concentration of NOx component of the pressurized gas, and in each of the combustors, the rate of the amount of air supplied into the combustor by the second air supply means in relation to the amount of combustion air supplied into the combustor by the first air supply means is increased when the measured NOx density concentration of the pressurized gas is higher than the desired NOx density concentration of the pressurized gas.

9. A method according to claim 1, wherein a concentration of a CO (carbon monoxide) component of the pressurized gas is measured as the measured combustion condition, the desired combustion condition is a desired concentration of CO component of the pressurized gas, and in each of the combustors, the rate of the amount of air supplied into the combustor by the second air supply means in relation to the amount of combustion air supplied into the combustor by the first air supply means is decreased when the measured CO concentration of the pressurized gas is higher than the desired CO concentration of the pressurized gas.

10. A method according to claim 2, wherein the desired combustion condition is an average combustion condition of the measured combustion conditions of all of the combustors.

11. A method according to claim 2, wherein the desired combustion condition is an average combustion condition of the measured combustion conditions of at least two of the combustors other than the combustor where the difference is being measured.

12. A method according to claim 1, wherein the measured combustion condition of each of the combustors is measured at a downstream side of the gas turbine.

13. A method for controlling a combustor supplying a pressurized gas to a gas turbine, said combustor including a combustion chamber having a first, diffusion combustion part and a second, premixed combustion part, a first air supply means for supplying a combustion air into the first, diffusion combustion part of said combustion chamber, and a second air supply means for adjusting an amount of air supplied into the second, premixed combustion part of said combustion chamber of the combustor to change a combustion condition of the combustor, the method comprising the steps of:

measuring a temperature of the pressurized gas, measuring a difference between the measured value of the pressurized gas and a desired value thereof which corresponds to a desired combustion condition of the combustor, and changing a rate of the amount of air supplied by the second air supply means with respect to the amount of air supplied by the first air supply means in accordance with the measured difference to change the combustion condition of said combustor.

14. A method for controlling a combustor supplying a pressurized gas to a gas turbine, said combustor including a combustion chamber having a first, diffusion combustion part and a second, premixed combustion part, a first air supply means for supplying a combustion air into the first, diffusion combustion part of said combustion chamber, and a second air supply means for adjusting an amount of air supplied into the second, premixed combustion part of said combustion chamber of the combustor to change a combustion condition of the combustor, the method comprising the steps of:

measuring a concentration of a component of the pressurized gas, measuring a difference between the measured value of the pressurized gas and a desired value thereof which corresponds to a desired combustion condition of the combustor, and changing a rate of the amount of air supplied by the second air supply means with respect to the amount of air supplied by the first air supply means in accordance with the measured difference to change the combustion condition of the combustor.

15. A method for controlling a combustor supplying a pressurized gas to a gas turbine, said combustor including a combustion chamber having a first, diffusion combustion part and a second, premixed combustion part, a first air supply means for supplying a combustion air into the first, diffusion combustion part of said combustion chamber, and a second air supply means for adjusting an amount of air supplied into the second, premixed combustion part of said combustion chamber of the combustor to change a combustion condition of the combustor, the method comprising the steps of:

measuring at least one of a temperature and a concentration of a component of the pressurized gas, measuring a difference between the measured value of the pressurized gas and a desired value thereof which corresponds to a desired combustion condition of the combustor, and changing a rate of the amount of air supplied by the second air supply means with respect to the amount of air supplied by the first air supply means in accordance with the measured difference to change the combustion condition of said combustor.

* * * * *